US007177572B2

(12) United States Patent
DiRubio et al.

(10) Patent No.: US 7,177,572 B2
(45) Date of Patent: Feb. 13, 2007

(54) BIASED CHARGE ROLLER WITH EMBEDDED ELECTRODES WITH POST-NIP BREAKDOWN TO ENABLE IMPROVED CHARGE UNIFORMITY

(75) Inventors: Christopher A. DiRubio, Webster, NY (US); Michael D. Thompson, Rochester, NY (US); Gerald M. Fletcher, Pittsford, NY (US); Charles A. Radulski, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 288 days.

(21) Appl. No.: 10/875,554

(22) Filed: Jun. 25, 2004

(65) Prior Publication Data

US 2005/0286934 A1 Dec. 29, 2005

(51) Int. Cl.
*G03G 15/02* (2006.01)

(52) U.S. Cl. ..... 399/176

(58) Field of Classification Search ..... 399/174, 399/175, 176, 50, 313, 314; 361/225
See application file for complete search history.

(56) References Cited

U.S. PATENT DOCUMENTS

| | | | | |
|---|---|---|---|---|
| 2,807,233 | A | | 9/1957 | Fitch |
| 2,912,586 | A | | 11/1959 | Gundlach |
| 3,043,684 | A | | 7/1962 | Mayer |
| 3,398,336 | A | | 8/1968 | Martel et al. |
| 3,684,364 | A | | 8/1972 | Schmidlin |
| 3,702,482 | A | | 11/1972 | Dolcimascolo et al. |
| 3,781,105 | A | | 12/1973 | Meagher |
| 3,830,589 | A | | 8/1974 | Allen |
| 3,832,053 | A | | 8/1974 | Goel et al. |
| 3,832,055 | A | | 8/1974 | Hamaker |
| 3,936,174 | A | | 2/1976 | Carpenter |
| 4,783,716 | A | * | 11/1988 | Nagase et al. ..... 361/225 |
| 4,837,980 | A | | 6/1989 | Rogers, Jr. |
| 4,851,960 | A | | 7/1989 | Nakamura et al. |
| 5,164,779 | A | | 11/1992 | Araya et al. |
| 5,276,490 | A | | 1/1994 | Bartholmae et al. |
| 5,303,013 | A | | 4/1994 | Koike et al. |
| 5,583,623 | A | | 12/1996 | Bartholmae et al. |
| 5,613,173 | A | | 3/1997 | Kunzmann et al. |
| 5,634,179 | A | | 5/1997 | Umeda et al. |
| 5,697,034 | A | | 12/1997 | Iwakura et al. |
| 6,075,965 | A | | 6/2000 | Tombs et al. |
| 6,203,743 | B1 | | 3/2001 | Reese |

(Continued)

FOREIGN PATENT DOCUMENTS

EP 0 642 063 A1 3/1995

(Continued)

*Primary Examiner*—Robert Beatty
(74) *Attorney, Agent, or Firm*—Oliff & Berridge PLC

(57) ABSTRACT

Electrodes are embedded in a biased charge roller of a xerographic device. The electrodes, which may run the length of the roller, are deposited on an insulating substrate. A semi-conductive conformable layer of a flexible elastomer covers the electrodes. The semi-conductive conformable layer limits current flow between electrodes and relaxes charge deposited on the roller surface. Stationary pre-nip and post-nip contacts apply the bias to the imbedded electrodes. The electrodes in the post nip region are biased to $V_{POST}$. The electrodes positioned in the pre-nip regions are either grounded or biased to $V_{PRE}<V_{POST}$. The electroded biased charge roller may generate air breakdown in the post nip region, resulting in highly uniform charging.

19 Claims, 9 Drawing Sheets

U.S. PATENT DOCUMENTS 6,360,065 B1 3/2002 Ishibashi et al.
6,606,477 B2 * 8/2003 Thompson et al. ..... 399/313

FOREIGN PATENT DOCUMENTS

EP 0 642 063 B1 3/1995
JP 06118811 A * 4/1994
JP 10069149 A * 3/1998
JP 10307453 A * 11/1998
JP 2003-173068 A * 6/2003

* cited by examiner

BIASED CHARGE ROLLER WITH EMBEDDED ELECTRODES WITH POST-NIP BREAKDOWN TO ENABLE IMPROVED CHARGE UNIFORMITY

BACKGROUND OF THE INVENTION

1. Field of Invention

The present invention relates generally to biased charge rollers for high speed xerographic printing, and more particularly, to biased charge rollers with commutated longitudinal electrodes embedded below the surface of the roller to control the deposition of charge onto a charge retentive surface.

2. Description of Related Art

Typically, electrostatic imaging and printing processes are comprised of several distinct stages. These stages may generally be described as (1) charging, (2) imaging, (3) exposing, (4) developing, (5) transferring, (6) fusing, and (7) cleaning. In the charging stage, a uniform electrical charge is deposited on a charge retentive surface, such as, for example, a surface of a photoreceptor, so as to electrostatically sensitize the surface. Imaging converts the original image into a projected image exposed upon the sensitized photoreceptor surface. An electrostatic latent image is thus recorded on the photoreceptor surface corresponding to the original image. Development of the electrostatic latent image occurs when charged toner particles are brought into contact with this electrostatic latent image. The charged toner particles will be attracted to either the charged or discharged regions of the photoreceptor surface that correspond to the electrostatic latent image, depending on whether a charged area development (CAD) or discharged area development (DAD, more common) is being employed. In the case of a single step transfer process, the photoreceptor surface with the electrostatically attracted toner particles is then brought into contact with an image receiving surface, i.e., paper or other similar substrate. The toner particles are imparted to the image receiving surface by a transferring process wherein an electrostatic field attracts the toner particles towards the image receiving surface, causing the toner particles to adhere to the image receiving surface rather than to the photoreceptor. The toner particles then fuse into the image receiving surface by a process of melting and/or pressing. The process is completed when the remaining toner particles are removed from the photoreceptor surface by a cleaning apparatus.

To charge the surface of a photoreceptor, it is known to use a contact type charging device. The contact type charging device includes a conductive member which is typically supplied a voltage from a power source with a DC voltage ($V_{DC}$) superimposed with an AC voltage with a peak to peak amplitude ($V_{AC}$) of at least twice the threshold voltage for air breakdown ($V_{TH}$). Note that $V_{TH}$~312+87.96 $\sqrt{D_{OPC}}$+6.2$D_{OPC}$, where $D_{OPC}=d_{OPC}/k$ is the dielectric thickness of the photoreceptor in units of microns (um or μm), $d_{OPC}$ is the thickness of the photoreceptor, and k is the photoreceptor dielectric constant. This equation is valid if the charge roller is sufficiently conductive. For a photoreceptor with $D_{OPC}$=7.6 microns, $V_{TH}$=600V and therefore $V_{AC}$>1200V. When using a conventional DC biased AC BCR (biased charge roller), the photoreceptor charge potential is given by $V_{OPC}=V_{DC}$, where $$V_{OPC} = \frac{\sigma D_{OPC}}{\varepsilon_0}$$

is the photoreceptor charge potential, σ=Q/A is the surface charge density (charge per unit area) deposited on the photoreceptor surface, and $\epsilon_0$ is the permittivity of free space. The charging device contacts the image bearing member (photoreceptor) surface, which is a member to be charged. The outer surface of the photoreceptor is charged by air breakdown in the pre-nip and post-nip air gaps. The contact type charging device charges the photoreceptor to a predetermined potential ($V_{OPC}$). Typically, the contact type charger is in the form of a roll charger such as that disclosed in U.S. Pat. No. 4,387,980 (see also U.S. Pat. Nos. 4,851,960; 5,164,779; 5,613,173; and 2,912,586) which are hereby incorporated by reference.

In contact type charging systems, it is important that the charging member contacts the charge retentive surface, such as the photoreceptor uniformly along the length thereof. Contact charge type rollers therefore typically include a conformable material to maintain the contact with the photoconductive member. In typical printing applications, AC and/or DC voltages are applied to a roll type charger in contact with a photoconductive drum.

The area between the charge retentive surface and the charge roller surface may be divided into three distinct regions: the nip region, the pre-nip region, and the post-nip region. The nip region comprises the point at which the charge retentive surface and the charge roller surface come into direct contact. The pre-nip region comprises the region upstream from the nip region. In the pre-nip region, there is an air gap between the charge retentive surface and the charge roller surface since the two have not yet come into direct contact. The post-nip region is downstream from the nip region. There is also an air gap between the charge retentive surface and the charge roller surface in the post-nip region.

It is well known that DC biased charging devices have poor charge uniformity because air breakdown in the pre-nip air gap suppresses air breakdown in the post-nip region. It has been demonstrated that post-nip breakdown charges a charge retentive surface, such as, for example, a photoreceptor much more uniformly than pre-nip breakdown. Conventional AC biased charging rollers, a commonly used form of biased charging, use a DC shifted AC high voltage power supply to generate post-nip air breakdown. Although the high voltage AC improves the charge uniformity, it has several disadvantages including additional cost and increased photoreceptor wear.

DC shifted AC biased charge rollers are a part of a commonly used biased charging technology in low volume xerographic engines. Air breakdown occurs in both the pre-nip and the post-nip region. These commonly used biased charge rollers tend to have adequate charge uniformity and they generate little ozone. However, there are several problems associated with the high voltage AC including a high rate of wear, additional costs, banding, and process speed limitations.

For example, the AC biased charge roller deposits both positive and negative charge on the photoreceptor. The positive charge weakens the photoreceptor polymer, which is subsequently abraded by a cleaner blade, increasing wear and reducing its life. It has been shown that eliminating the positive charge deposition from a biased charge roller increases photoreceptor life by a factor of two.

In another example, the conventional biased charge roller further requires an expensive high voltage AC power supply in addition to the DC power supply. The AC also causes audible noise by vibrating the photoreceptor. Noise dampening countermeasures are required to reduce the volume of this noise, adding additional costs.

Further, AC causes high frequency spatial banding ($X=V_{PROCESS}/f$) that is normally not noticeable to the observer. As the process speed is increased, the frequency of the AC must be increased to prevent the high frequency spatial banding from becoming apparent. The AC current is proportional to 1/f, so a larger, more costly power supply is required.

One of the primary factors limiting the applicability of DC biased charging is non-uniform charging. When sufficiently high negative DC voltage is applied to the shaft of a biased charge roller, the field in the pre-nip regions exceeds the Paschen curve, resulting in air breakdown. Negative charge is deposited on the photoreceptor until the field at all air gaps collapses and lies below the Paschen curve. Therefore there will be no air breakdown in the post-nip regions, and the charging will be non-uniform. However, if the resistivity of the biased charge roller elastomer is precisely tuned so that the charge relaxation time is roughly equal to the dwell time in the nip, the post nip field will exceed the pre-nip field and the charging will be uniform. This is generally not practical because it requires extremely tight control of the resistivity. In addition, when the resistivity is in this "field tailoring" regime, the DC BCR has an increased sensitivity to ghosting defects that result when the charge deposited on the photoreceptor depends on the discharge pattern (latent image) from the previous photoreceptor cycle. This can lead to a "ghost image" of the previous latent image appearing on the print.

The electroded DC biased charging roller described here enables post-nip charging and excellent charge uniformity without suffering from the AC biased charge roller disadvantages described above. The electroded DC BCR also avoids the problems associated with the field tailoring DC BCRs described above.

The present invention provides a biased charge roller wherein a uniform electrical charge is deposited on the surface of a photoreceptor so as to electrostatically sensitize the surface. The biased charge roller of the present invention has several advantages in that the biased charge roller of the present invention provides uniform charging and allows for substantial decreased wear and costs.

SUMMARY OF THE INVENTION

In view of the foregoing background, it is an object of the present invention to provide a less expensive biased charge roller system in which charge uniformity is improved and decreased wear is obtained.

These and other objects of the present invention are achieved by embedding electrodes into a biased charge roller. Electrodes may be biased such that the electric fields leading into and out of the charging nip region can be easily and precisely controlled to avoid the above-mentioned imaging defects.

The electrodes are embedded onto a biased charge roller substrate. The electrodes are subsequently surrounded by a semi-conductive layer that can relax the charge accumulated on the surface of the biased charge roller. The semi-conductive layer may be a conformable or a non-conformable stiff layer.

The electrodes may be biased in several different schemes. The electrodes may be grounded in the pre-nip and within-nip regions, but biased in the post-nip region. All three regions may be biased, or the bias may be varied within each individual region. The bias may even be applied to widely separated electrodes to allow the voltage drop along the semi-conductive surface layer between them to provide the field tailoring. The electrodes far from the nip may be either grounded or biased to facilitate the relaxation of charge that has accumulated on the biased charge roller surface. Each electrode may be biased individually, or the electrodes may be biased in groups of one or more. The bias on each electrode (or group) may differ, or one or more electrodes (or groups) may be at the same bias. Although the groups may include post-nip electrodes, far post-nip electrodes, within nip electrodes, pre-nip electrodes, and far pre-nip electrodes, other groupings are possible. The bias may be DC, AC, or DC biased AC, and the power supply (or supplies) may be operated in either constant voltage or constant current mode.

BRIEF DESCRIPTION OF THE DRAWINGS

Other features of the present invention will become apparent as the following description proceeds and upon reference to the drawings, in which.

DETAILED DESCRIPTION OF PREFERRED EMBODIMENTS

The present invention relates to a biased charge roller onto which the electrodes are embedded. A semi-conductive layer that is able to relax the accumulated charge on the surface of the roller, substantially covers the electrodes. The semi-conductive layer may be conformable or non-conformable, but is preferably conformable, such as, for example, a conformable elastomer. Although a conformable layer is preferred, a stiff layer may be used, for example, for a gapped (non-contacting) biased charge roller (BCR), and could also be possibly used (but not preferably) for a contacting roller. The electrodes may be biased in various schemes to control the pre-nip and post-nip fields, as well as the nip field.

Figure 1:
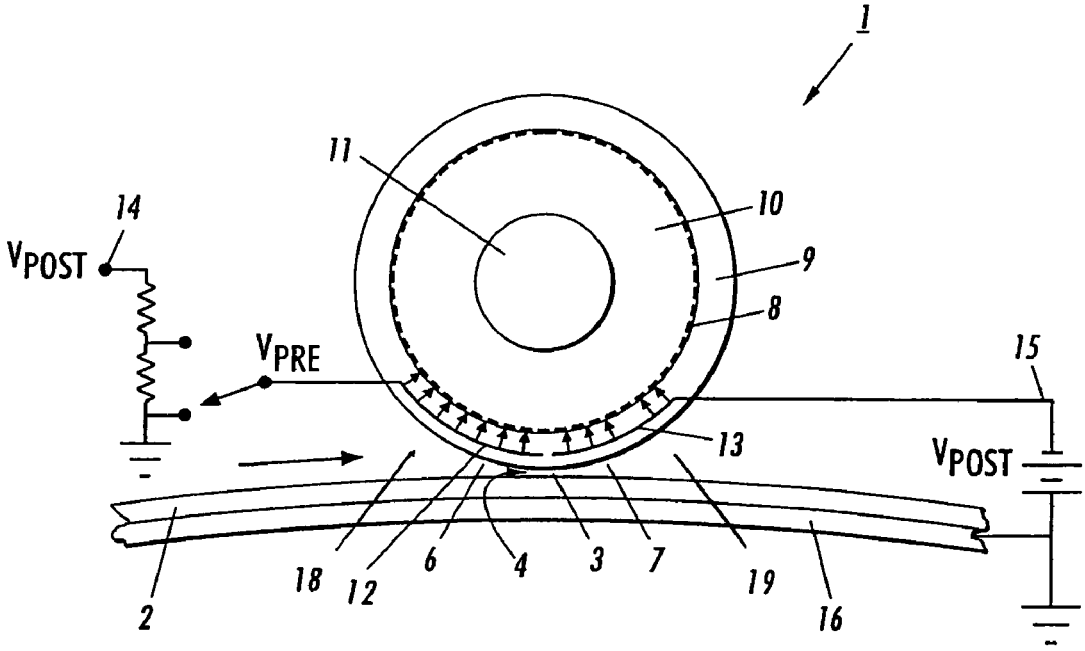
FIG. 1 is an axial cross-sectional view of an electroded biased charge roller system in an embodiment of the present invention.

FIG. 1 depicts a cross-sectional view of the electroded biased charge roller system. The biased charge roller (1) is adjacent to a photoreceptor surface (2) surrounding a photoreceptor ground plane (16). The biased charge roller (1) and photoreceptor surface (2) come into closest proximity at the nip region (3).

Upstream from the nip region (3) is the pre-nip region (6). Upstream from the pre-nip region (6) is the far-pre-nip region (18). In the pre-nip region (6), there is an air gap between the outer surface of the photoreceptor (2) and the biased charge roller (1). The photoreceptor may be of any suitable design, for example, a belt or drum. There is a corresponding post-nip region (7) downstream from the nip region (3), wherein there is an air gap separating the photoreceptor surface (2) from the biased charge roller (1). Downstream from the post-nip region (7) is the far-post-nip region (19).

The biased charge roller (1) comprises numerous commutated longitudinal electrodes (8) on or embedded in an insulating substrate layer (10). The insulating substrate layer (10) substantially covers a shaft (11). The shaft (11) may be made of any material that can support the insulating substrate layer (10). The shaft (11) may be conductive or non-conductive. For example, the shaft (11) may be a steel shaft. The electrodes may be individually charged by different voltages through the stationary pre-nip contact (12) or the stationary post-nip contact (13). The contacts are connected respectively to power sources (14) and (15). A semi-conductive layer (9) covers the insulating substrate layer (10). It is envisioned that more complex arrangements of stationary contacts may be employed. For example, separately biased stationary contacts for the contact nip region (3), the pre-nip region (6), a far pre-nip region, the post-nip region (7), and a far post-nip region may be employed.

Figure 2:
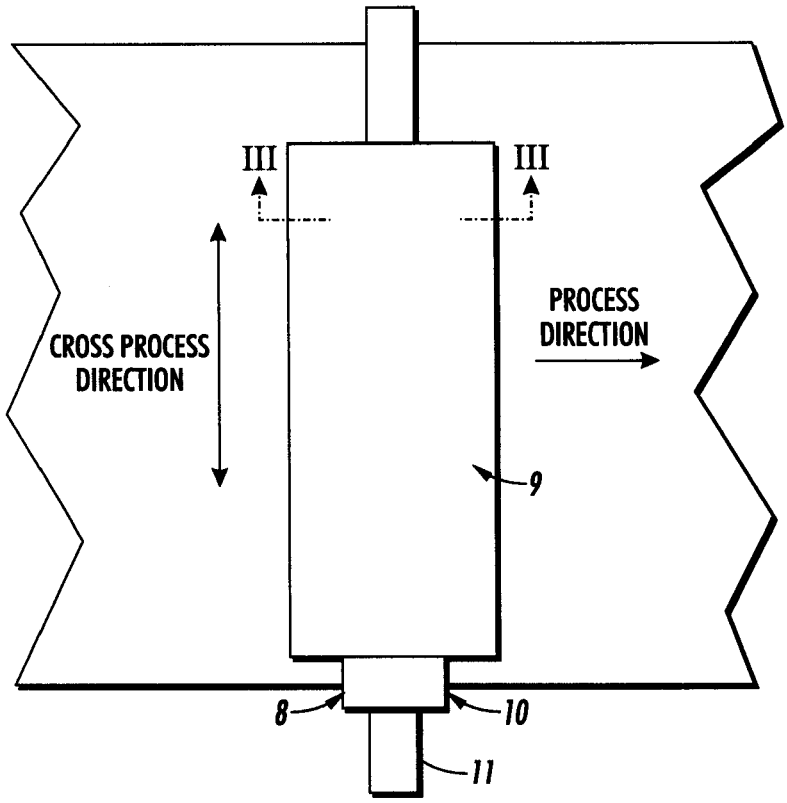
FIG. 2 is a top view of an electroded biased charge roller in an embodiment of the present invention.
Figure 3:
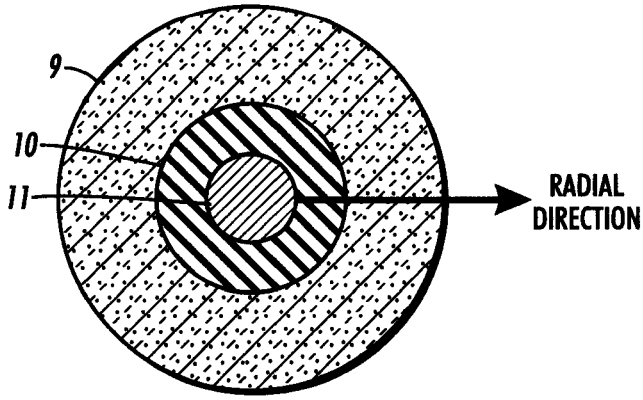
FIG. 3 is a cross-sectional view of the electroded biased charge roller of FIG. 2 taken along line III—III of FIG. 2.
Figure 4:
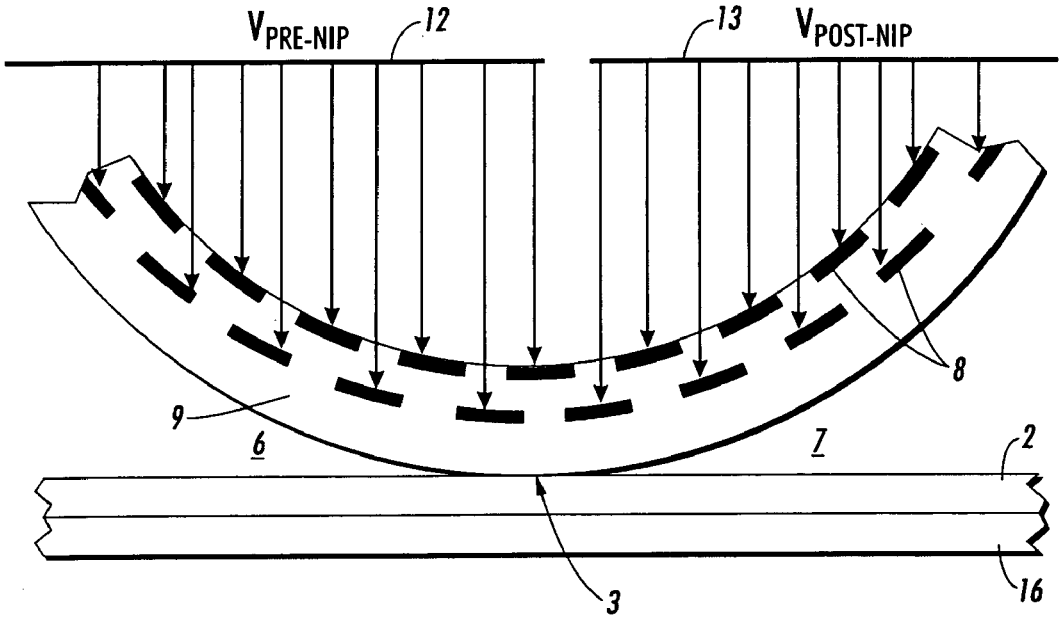
FIG. 4 is a cross-sectional view of an electroded biased charge roller and photoreceptor surface in an embodiment of the present invention.

FIG. 2 depicts a top view of the biased charge roller (1) and FIG. 3 depicts a cross-sectional view of the biased charge roller (1). The shaft (11) is covered by the insulating substrate layer (10). The surface of the insulating substrate is substantially covered by a semi-conductive layer (9). Referring to FIGS. 1 and 4, the electrodes (8) may alternatively be embedded in the semi-conductive layer (9) or between the semi-conductive layer (9) and the insulating substrate layer (10). However, for ease of manufacturing, in a preferred embodiment, the electrodes (8) will be deposited on the insulating substrate layer (10).

The insulating substrate layer (10) is composed of an insulator material, such as, for example, a polyamide overcoat, or any like insulating material. The insulating substrate layer (10) substantially covers the shaft (11) and has a thickness of, for example, about 0.1 mm to about 20 mm. Typically, the shaft may be about 6 to about 10 mm in diameter. The insulating substrate layer (10) may be about 5 to about 10 mm thick, and the relaxable elastomer may be about 0.2 mm about 1 mm thick. Note that other thicknesses may be used in appropriate designs without limitation.

Referring again to FIGS. 2 and 3, the electrodes (8) preferably run substantially the entire length of the biased charge roller (1), although other patterns may also be used. Each of the electrodes (8) are, for example, about 0.05 mm to about 3 mm wide in the process direction (the length of the roll). Preferably, the electrodes (8) are each about 0.2 to about 0.7 mm wide in the process direction. The thickness of each of the electrodes (8), perpendicular to the surface in the radial direction, is preferably less than, for example, about 50 microns. Further, the electrodes (8) are preferably spaced apart from one another in a regular pattern such that there is about a 0.05 mm to about a 3 mm gap between each electrode on the surface of the insulating substrate layer (10). Preferably, the gap between each of the electrodes (8) is about 0.2 mm to about 0.7 mm. The size and gap space of the electrodes should be such to allow the electrodes (8) to be close enough to each other to ensure precise control over the electric fields generated, yet far enough apart to limit the current flow between individual electrodes. Other dimensions may also be used in appropriate designs without limitation.

Figure 5:
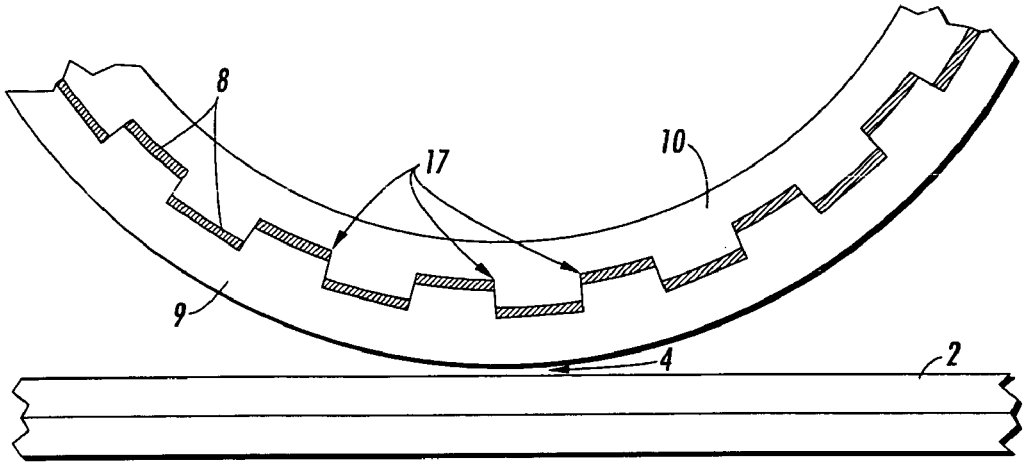
FIG. 5 is a cross-sectional view of an electroded biased charge roller and photoreceptor surface in an embodiment of the present invention.
Figure 6:
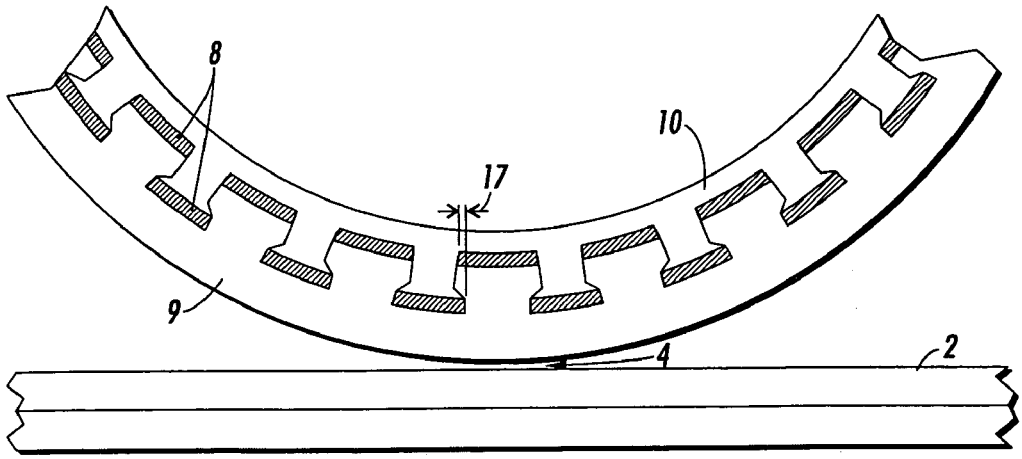
FIG. 6 is a cross-sectional view of an electroded biased charge roller and photoreceptor surface in an embodiment of the present invention.

FIG. 5 illustrates a pattern with the electrodes (8) having no offset between the electrodes (8) in the process direction and FIG. 6 illustrates a pattern were the electrodes (8) overlap in the process direction. The electrodes (8) may be located on the surface of the insulating substrate layer (10), wherein the insulating substrate layer (10) preferably extends beyond the semi-conductive layer (9) in the cross-process direction. See FIG. 2. The shaft (11), in turn, preferably extends beyond the insulating substrate layer (10) in the cross-process direction.

The high voltage bias supply contacts the exposed electrodes (8) through stationary electrodes, for example, conductive brushes (12) and (13) (see FIG. 1). The bias power supply unit may be controlled via a device implementing a pre-programmed control routine (e.g., a computer or the like). The power supply for the electrodes may be DC, AC or DC biased AC. Further, the power supply or supplies may be either constant current, constant voltage, or a combination.

Noncontacting charging may, however, also be employed. Referring to FIGS. 1, 5 and 6, there is an air gap (4) between surface of the charging member and the photoreceptor surface. The threshold voltage (see equation above) will be independent of the air gap ($d_{AIR}$) if $d_{AIR} \leqq d_{TH} = 7.09\sqrt{D_{OPC}}$. For example if $D_{OPC}$=7.6 um, then $d_{AIR}$<=20 um. If the air gap (4) exceeds this threshold, then $V_{TH}$ will depend on the size of the air gap (4) and non-uniformities in the air gap (4) in the cross-process direction can result in charge non-uniformities. FIG. 2 illustrates this definition of a cross-process. This is particularly true for purely DC BCRs (no AC voltage) where $V_{OPC}=V_{DC}+V_{TH}$ when $V_{DC}<0$. For example, if $V_{TH}$=600V and $V_{DC}$=−1100V, the charge potential on the OPC would be $V_{OPC}$=−500V. Although, it is preferable to have the air gap (4) less than $d_{TH}$ (as defined above), the device of the present invention can also function at larger air gaps. At air gaps above $d_{TH}$ there are two disadvantages. First, the threshold voltage would increase, requiring higher applied voltages ($V_{DC}$) to achieve a given photoreceptor charge voltage, $V_{OPC}$. Second, the gap tolerance would need to be carefully controlled to avoid cross-process charge non-uniformities.

Figure 7:
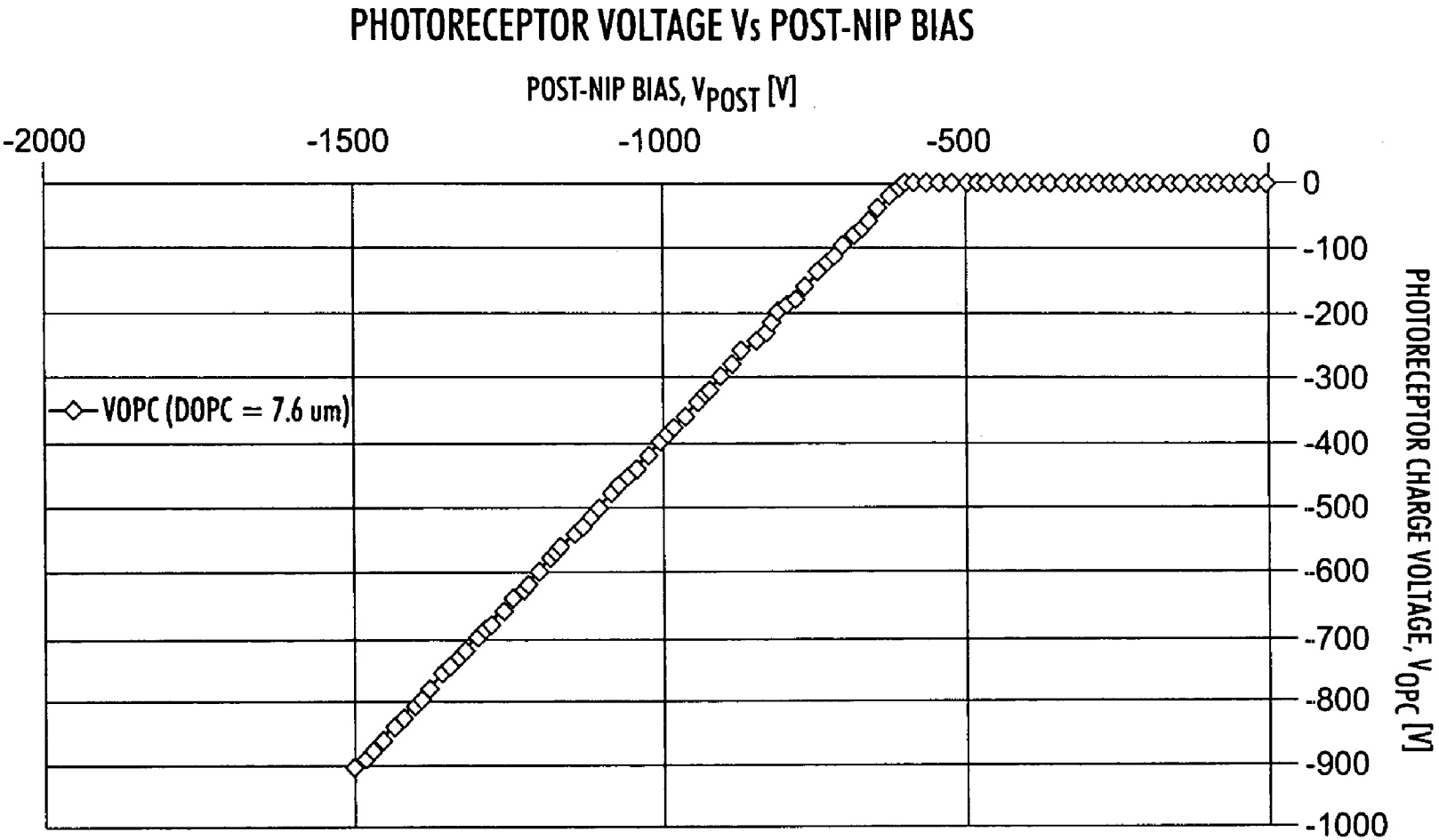
FIG. 7 is a chart illustrating the relationship between the bias of the photoreceptor voltage at the postnip region and the charge of the photoreceptor.
Figure 8:
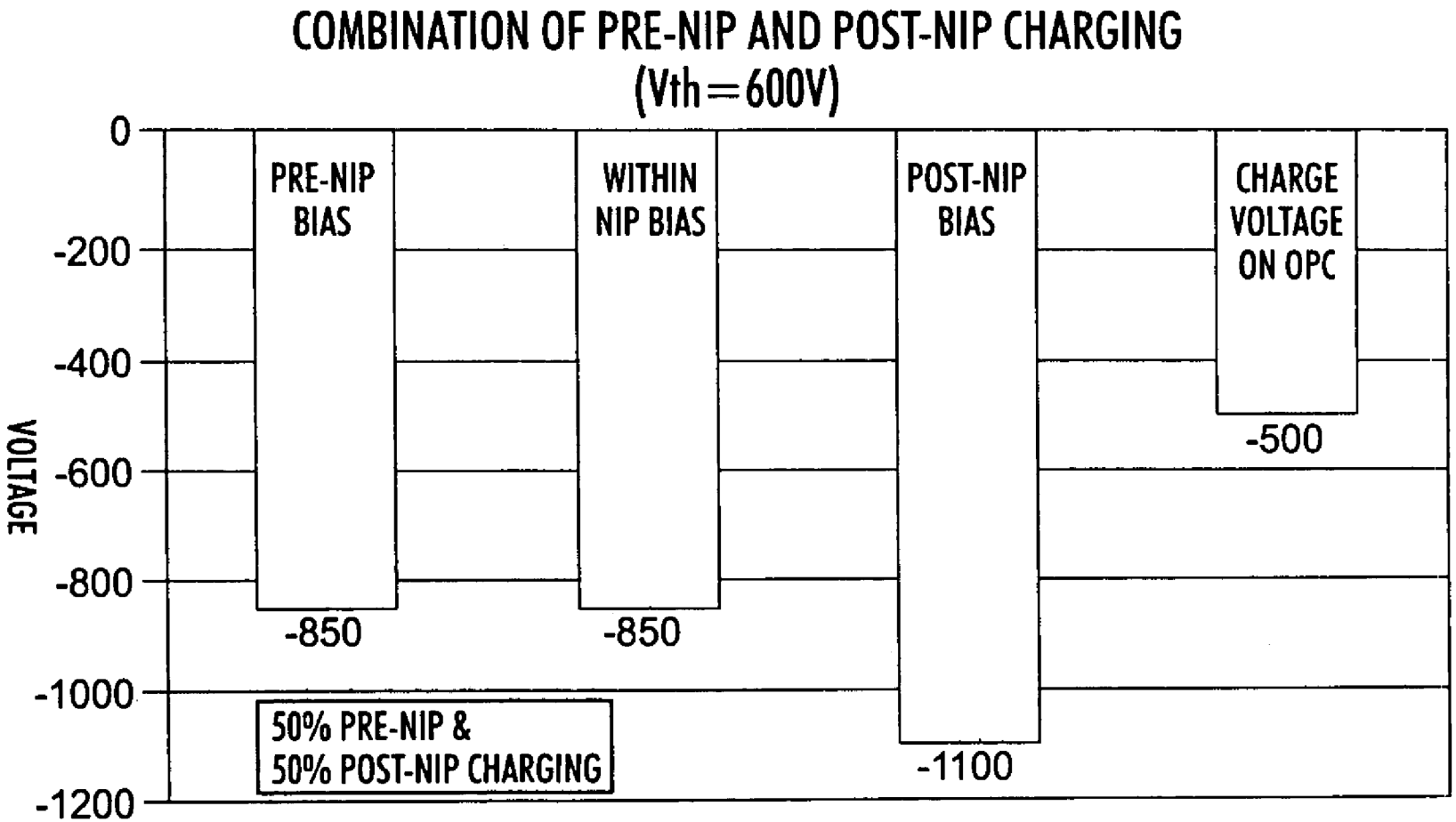
FIGS. 8–11 illustrate different embodiments of pre-nip and post-nip charging.
Figure 9:
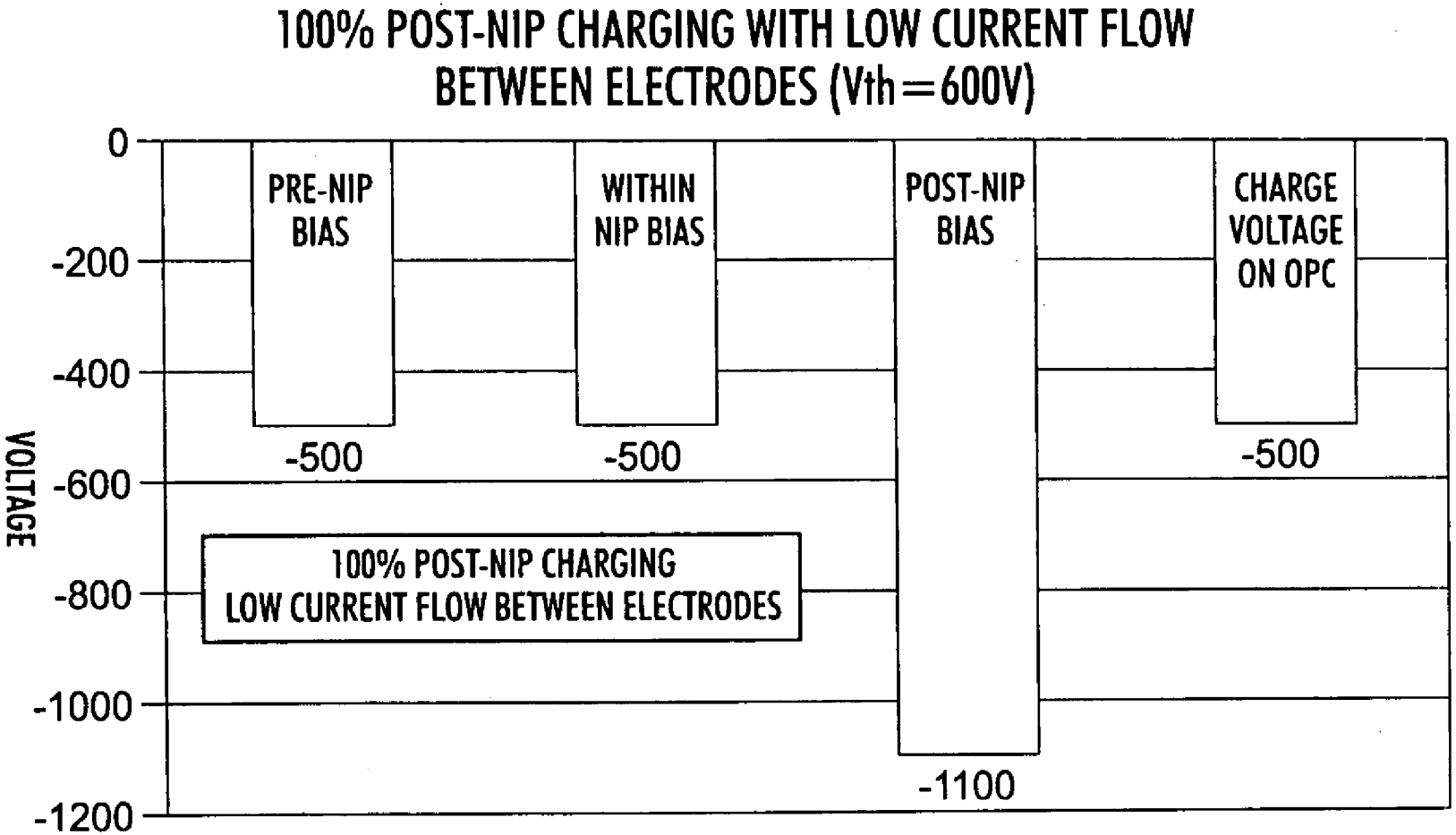
Figure 10:
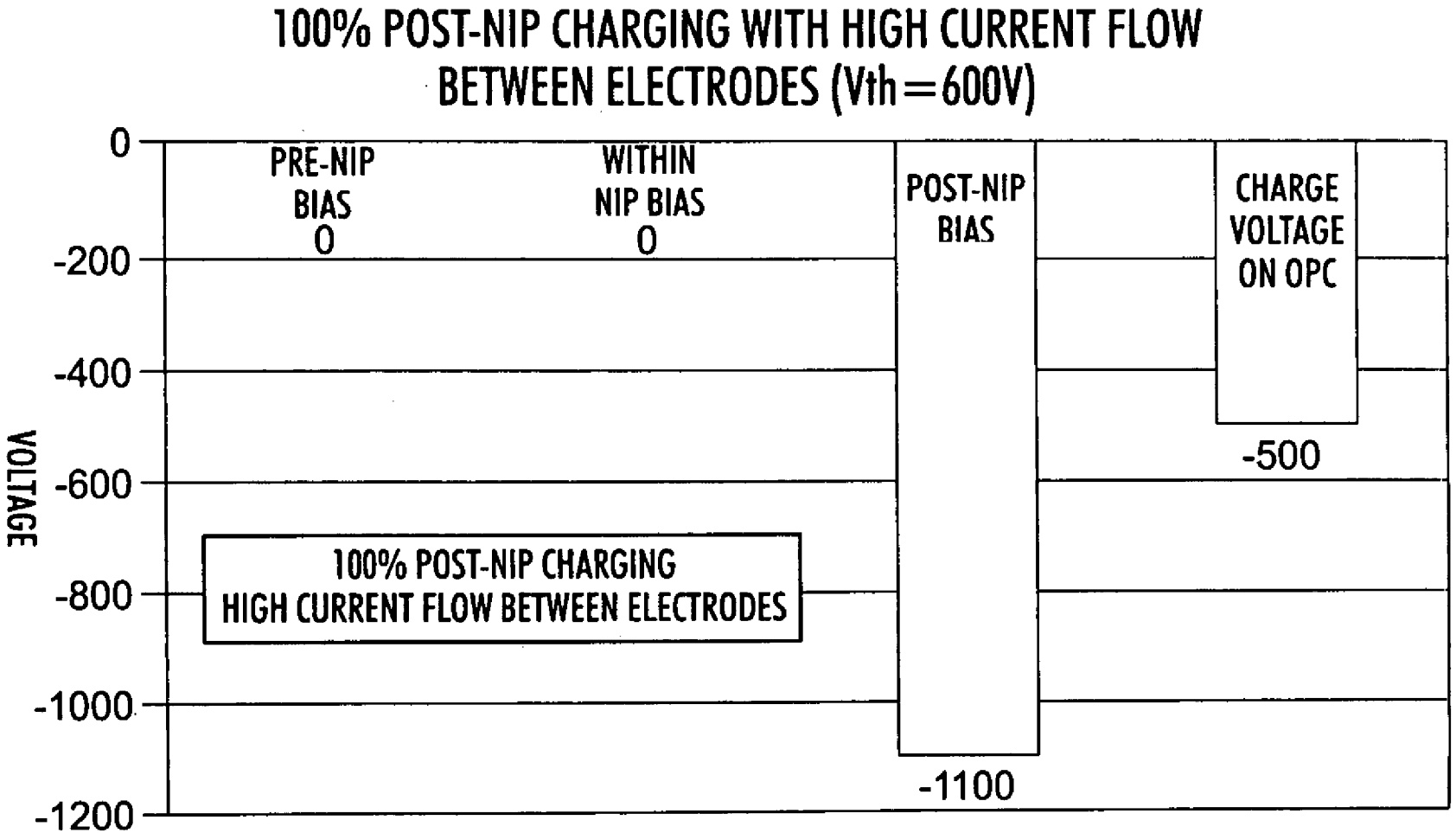
Figure 11:
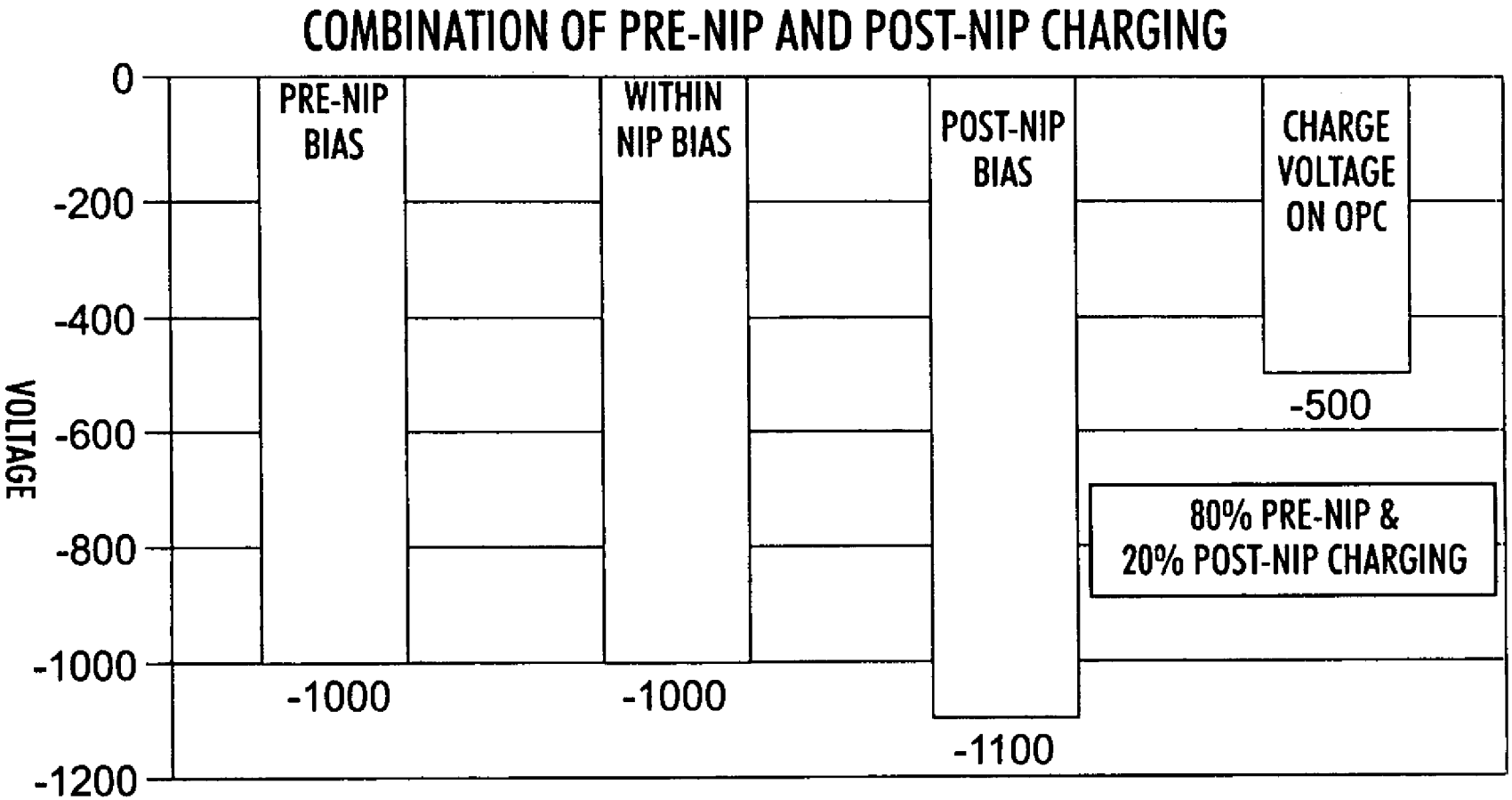

In a preferred embodiment, the electrodes are biased such that $|V_{POSTNIP}|>(|V_{PRENIP}|=|V_{NIP}|)>V_{TH}$ (e.g., if $V_{TH}$=600V, then to achieve $V_{OPC}$=−500V, set $V_{POSTNIP}$=−1100V and $V_{PRENIP}=V_{NIP}$=−850V) to achieve a mixture of pre-nip and post-nip breakdown. The pre-nip breakdown helps reduce ghosting effects and the post-nip breakdown insures excellent charge uniformity. In fact, the overall charge uniformity is optimized by a mixture of pre-nip and post-nip breakdown. This arrangement also reduces current flow between the electrodes which opens up the resistivity latitude window for the semi-conductive elastomer. FIGS. 7–11 illustrate this and other useful embodiments. These include $|V_{POSTIP}|>V_{TH}>(|V_{PRENIP}|=|V_{NIP}|)$ case which results in purely post-nip breakdown. FIG. 7 shows the relationship between $V_{POSTNIP}$ and $V_{OPC}$($V_{OPC}=V_{POST}+V_{TH}$).

FIGS. 5 and 6 show adjacent electrodes offset in a radial direction. In FIG. 6, the electrodes overlap in the process direction, and in FIG. 5, an offset (17) is equal to 0 mm between the electrodes in the process direction.

The semi-conductive layer (9) must be resistive enough to limit current flow between the electrodes (8). However, the semi-conductive layer (9) must also be conductive enough to ensure that the charge generated and deposited on the biased charge roller surface can quickly relax.

In a preferred embodiment, the semi-conductive layer (9) comprises a flexible elastomer. The elastomer should preferably be flexible enough to form a fairly uniform contact nip along the full length of the roller. The Shore O hardness may preferably range from, for example, 0 to about 100, but typically is from about 15 to about 80. The elastomer may be, for example, urethane rubber, epichlorohydrin elastomers, EPDM rubbers, styrene butadiene rubbers, fluoroelastomers, silicone rubbers, or any other suitable material. The materials may be doped with either ionic species or conductive fillers to vary the resistivity of the elastomer, if desired. Any other suitable method for controlling the elastomer resistivity may also be employed. The semi-conductive layer (9) may have any suitable thickness such as, for example, about 0.02 mm to about 10 mm, preferably from about 0.2 mm to about 1 mm. It is also possible to use a stiff, non-conformable semi-conductive layer.

In a preferred embodiment, the semi-conductive layer (9) will have a relaxation time of $t_{RELAX}<\sim 0.2\times(W_{ELECTRODE}/V_{PROCESS})$ where $W_{ELECTRODE}$ is the width of one embedded electrode, and $V_{PROCESS}$ is the speed of the xerography process. To achieve this relaxation time the resistivity of the elastomer should ideally satisfy $$\rho < \frac{t_{RELAX} D_{OPC}}{d\varepsilon_0},$$

where d is the thickness of the elastomer, $D_{OPC}$ is the dielectric thickness of the photoreceptor, and $\epsilon_0$ is the permittivity of free space. A typical process speed is about 100 mm/s (about 25 pages per minute) to 250 mm/s (about 60 pages per minute), although the present invention may be used at higher (>300 mm/s) or lower speeds. Preferably, $W_{ELECTRODE}$ is about 0.05 to about 6 mm, typically about 0.5 mm to about 3 mm. $V_{PROCESS}$ may be from about 25 mm/s to about 1250 mm/s.

Further, the semi-conductive layer (9) must be thick enough (d) to avoid dielectric breakdown ($E_{BREAK}$) under bias leak (short to photoreceptor ground due to small photoreceptor defects) conditions. Preferably, the $E_{BREAK}$ value is as large as possible. The breakdown field should exceed 1 V/micron, but values exceeding 100 V/micron may be necessary for thinner elastomers. For an elastomer with a breakdown field of 5 V/micron, d>0.2 mm would be necessary for a peak electrode bias of ~1100V. However, the semi-conductive layer (9) must also be thin enough to allow control over the electric fields in the pre-nip region (6) and the post-nip region (7). In general the semi-conductive layer (9) may have a resistivity (ρ) of, for example, about $10^4$ to about $10^{13}$ Ω-cm in this calculation. Higher and lower resistivity values can also be used.

The voltages of each region may be varied depending upon the desired effect upon the xerography process. The $V_{NIP}$, $V_{PRENIP}$, and $V_{POSTNIP}$ may have a voltage range from about −10,000 V to about 10,000 V or more depending on the charge sign of the toner. As described in more detail above, the final OPC voltage ($V_{OPC}$) depends on DC voltage applied in the post-nip region ($V_{POSTNIP}$) Note that for negative charging $V_{OPC}=V_{POSTNIP}+V_{TH}$, but for positive charging $V_{OPC}=V_{POSTNIP}-V_{TH}$. For example, to charge the photoreceptor to +500V, the post nip bias needs to be set to $V_{POSTNIP}$=+1100 V if $V_{TH}$=600 V.

$I_{MAX}$ is the maximum current that the power source may supply. A high current may be drawn if either the adjacent electrodes are biased at significantly different potentials, or if a photoreceptor belt or drum has a pinhole failure (i.e., a small permanent spot on the photoconductor which has a very low resistance to ground) and the biased charge roller shorts to ground. The maximum current ($I_{MAX}$) may typically be about 2 mA to about 3 mA, but may be any suitable value, including, for example, 10 mA or 20 mA or larger.

In one embodiment, $V_{PROCESS}$ is about 100 mm/s. The $V_{PRENIP}$ and $V_{NIP}$ are both about −850 V, and $V_{POSTNIP}$ is about −1100 V. This biasing scheme will create a photoreceptor charge potential of $V_{OPC}$=−500V if $V_{TH}$=600V (i.e., if $D_{OPC}$=7.6 um). The $I_{MAX}$ is about 1 mA, and $E_{BREAK}$ is about 5 V/micron. If the electrodes are separated by about 0.5 mm, and the thickness of the semi-conductive layer (9) is about 0.3 mm to about 0.5 mm, then the resistivity of the semi-conductive layer (9) under these stressful conditions is preferably about $3\times10^6$ Ω-cm to about $5\times10^8$ Ω-cm. This is a relatively wide resistivity latitude, and there are many relaxable elastomers that can hold this tolerance. As noted above, the maximum resistivity (ρ) of the semi-conductive layer is governed by the charge relaxation time. The minimum resistivity is determined by the current limit on the power supply which should not be exceeded due to either: (1) current flow to ground under bias leak conditions, or (2) current flow between electrodes at different biases.

When the resistivity is in the above preferred range, the charge on the semi-conductive layer (9) should relax within a time scale of less than about $W_{ELECTRODE}/V_{PROCESS}$ where $V_{PROCESS}$ is the speed of the xerography process. Because the relaxation time is so small, grounding some of the electrodes further from the nip is probably unnecessary. However, some of the electrodes further from the nip may nonetheless be either grounded or appropriately biased to prevent cyclic buildup of the charge deposited on the semi-conductive layer surface.

The biased charge roller (1) may further include a cleaner comprising a blade, a pad, or a brush cleaner (or any other type of cleaner) in order to minimize contamination of the biased charge roller. The cleaner, if present, is located outside the pre-nip region (6) and the post-nip region (7).

The electroded biased charge roller may be present in any xerographic system including those that employ a conventional biased charge roller. The electroded biased charge roller may vary the biasing scheme of the system. For example, all the electrodes in the pre-nip and nip regions may be grounded, but the electrodes in the post-nip region may be biased at high voltage (see FIGS. 8–11, for example). Further, there are other possible biasing schemes of the present invention including, but not limited to, the following examples.

The bias of the electrodes in the pre-nip, nip, and post-nip regions may all be varied. The bias may be varied within the pre-nip, post-nip, and/or nip regions of the biased charge roller. Each electrode may be biased separately, or groups of electrodes may be biased to the same potential. The bias may also be applied to widely separated electrodes wherein the voltage is allowed to drop along the semi-conductive surface layer between the biased electrodes in order to provide a smoothly varying potential between the biased electrodes.

Each electrode may be biased individually, or the electrodes may be biased in groups of one or more. The bias on each electrode (or group) may differ, or one or more electrodes (or groups) may be at the same bias. Although the groups may include post-nip electrodes, far post-nip electrodes, within nip electrodes, pre-nip electrodes, and far pre-nip electrodes, other groupings are possible. The bias may be DC, AC, or DC biased AC, and the power supply (or supplies) may be operated in either constant voltage or constant current mode.

It is envisioned that there are numerous variations of the location and materials of different parts of the charge roller system that may be used without departing from the scope of the present invention. For example, as shown in FIG. 1, the electrodes (8) could be placed closer together and the current limit on the power supply could be increased. When the electrode spacing is reduced, the current limit needs to be increased proportionally. In other words $I_{MAX}\Delta x_{ELECTRODE}=k$ where $\Delta x_{ELECTRODE}$ is the spacing between electrodes and k is a constant. To be more specific, k depends on the thickness, minimum desired elastomer resistivity, and length (in the cross process direction) of the elastomer, as well as the maximum voltage difference between adjacent electrodes.

Further, separations of $\Delta x_{ELECTRODE}$ may be less than 0.1 mm or smaller. The electrode pattern could also be altered to insure high uniformity in the charging regions. For example, as shown in FIG. 4, the electrodes may be provided evenly spaced in two lines so that the electrodes in the first line, overlap or nearly overlap with the electrodes in the second line. Referring to FIGS. 5 and 6, the electrodes overlap in the process direction (see FIG. 6), and have no offset (17) between the electrodes (8) (see FIG. 5) in the process direction. FIG. 5 shows a preferred embodiment in that this configuration would be easier to manufacture. In both these embodiments (FIGS. 5 and 6), the radial separation between the adjacent electrodes would preferably be between 0.1 mm and 1 mm, but values outside of this range are also possible. In each of these cases, the electrodes are mounted on the insulating substrate.

Further, the eleastomer thickness and resistivity can be optimized. For example, the eleastomer may be semi-conductive, and the region between two adjacent electrodes at the same voltage may approach an equipotential if the elastomer is sufficiently conductive.

Those skilled in the art will recognize that certain variations and/or additions can be made in the foregoing illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. An electroded biased charge roller for charging a charge retentive surface comprising:

an insulating substrate having an inner surface;

a semi-conductive layer over the insulating substrate; and a plurality of electrodes located at least in the insulating substrate, in the semi-conductive layer, or between the insulating substrate and the semi-conductive layer, the electrodes not extending radially through the inner surface of the insulating substrate toward the center of the electroded biased charge roller.

2. The electroded biased charge roller according to claim 1, wherein the charging member contacts the charge retentive surface uniformly along a length of the charge retentive surface.

3. The electroded biased charge roller according to claim 1, wherein the electroded biased charge roller is a contacting electroded charging roller or a gapped electroded charging roller.

4. The electroded biased charge roller according to claim 1, wherein the semi-conductive layer comprises a flexible elastomer having a Shore O hardness from 0 to about 100.

5. The electroded biased charge roller according to claim 1, wherein the semi-conductive layer has a thickness of about 0.02 mm to about 10 mm.

6. The electroded biased charge roller according to claim 1, wherein the plurality of embedded electrodes are separated from one another by about 0.05 mm to about 3 mm, on average.

7. The electroded biased charge roller according to claim 1, wherein each of the plurality of electrodes is about 0.05 mm to about 3 mm wide in a process direction.

8. The electroded biased charge roller according to claim 1, wherein the insulating substrate has a thickness of about 0.1 mm to about 20 mm.

9. The electroded biased charge roller according to claim 1, wherein at least one power supply for the plurality of electrodes is DC, AC or DC biased AC and wherein the at least one power supply is operated in either a constant current or a constant voltage mode.

10. The electroded biased charge roller according to claim 1, wherein a region between two adjacent electrodes at a same voltage approaches an equipotential.

11. A process of biasing the electroded biased charge roller of claim 1, comprising biasing the plurality of electrodes in a post-nip region and grounding the plurality of electrodes in pre-nip and nip regions.

12. The process of biasing the electroded biased charge roller of claim 11 wherein to achieve a mixture of pre-nip and post-nip breakdown, $|V_{POSTNIP}|>(|V_{PRENIP}|=|V_{NIP}|)>V_{TH}$ and further wherein at least one power supply for the plurality of electrodes is a DC constant voltage supply.

13. A process of biasing an electroded biased charge roller comprising the electroded bias charge roller of claim 1 and comprising the step of biasing the electrodes in a pre-nip, a post-nip, and/or a nip region, wherein the biasing of the electrodes in pre-nip, post-nip, or nip regions is different, and further wherein the biasing is applied to electrodes and allows a voltage drop along a surface of the semi-conductive layer to provide a varying potential between the biased electrodes, wherein each of the electrodes are biased individually, or biased in groups of one or more and further wherein the bias on each electrode or group of electrodes is at the same or different bias.

14. An image forming device including the electroded biased charge roller of claim 1 associated with the charge retentive surface.

15. An electroded biased charge roller, comprising:

an insulating substrate;

a semi-conductive layer over the insulating substrate; and a plurality of electrodes located in the semi-conductive layer, or between the insulating substrate and the semi-conductive layer, wherein the plurality of electrodes are deposited onto the insulating substrate, and substantially covered by the semi-conductive layer, wherein the electrodes longitudinally extend through the electroded biased charge roller to an end of the electroded biased charge roller, and wherein the electrodes are contacted substantially at the end of the electrically biased charge roller by stationary electrodes to provide the bias to the electrodes.

16. The electroded biased charge roller according to claim 15, wherein the electrically biased stationary electrodes are for a contact nip region, a pre-nip region, a far-pre-nip region, a post-nip region, and/or a far-post-nip region.

17. An electroded biased charge roller, comprising:

an insulating substrate;

a semi-conductive layer over the insulating substrate; and a plurality of electrodes located at least in the insulating substrate, in the semi-conductive layer, or between the insulating substrate and the semi-conductive layer, the semi-conductive layer exhibiting an approximate maximum relaxation time of a charge calculated by $$t_{RELAX}<0.2\times(W_{ELECTRODE}/V_{PROCESS})$$

where $W_{ELECTRODE}$ is a width of an embedded electrode and $V_{PROCESS}$ is a speed of a xerographic process.

18. The electroded biased charge roller according to claim 17, wherein a contact nip width is from about 0 mm to about 6 mm or more.

19. The electroded biased charge roller according to claim 17, wherein the semi-conductive layer has a resistivity from about $10^4$ Ω-cm to about $10^{13}$ Ω-cm.

* * * * *